United States Patent [19]

Brantner, Jr.

[11] Patent Number: 4,934,863

[45] Date of Patent: Jun. 19, 1990

[54] MASONRY TOOL

[76] Inventor: William F. Brantner, Jr., 224 Plum St., Williamsburg, Pa. 16693

[21] Appl. No.: 308,161

[22] Filed: Feb. 8, 1989

[51] Int. Cl.[5] ..... E01C 23/02

[52] U.S. Cl. ..... 404/87; 404/47; 404/48

[58] Field of Search ..... 404/87, 48, 74, 47

[56] References Cited

U.S. PATENT DOCUMENTS

| | | | |
|---|---|---|---|
| 789,992 | 5/1905 | Miller | 404/48 |
| 1,588,717 | 6/1926 | Fischer | 404/48 |
| 1,629,544 | 5/1927 | Shaw | 404/87 |
| 1,891,897 | 12/1932 | Fischer | 404/87 |
| 1,976,396 | 10/1934 | Holcomb | 404/47 |
| 3,132,571 | 5/1964 | Peters | 404/74 |
| 3,180,238 | 4/1965 | Crone | 404/48 |
| 3,413,900 | 12/1968 | Crone | 404/87 |

*Primary Examiner*—Jerome W. Massie
*Assistant Examiner*—Gay Ann Spahn
*Attorney, Agent, or Firm*—Richard L. Hansen

[57] ABSTRACT

This invention provides an adjustable, removable, reusable masonry tool for retaining expansion material employed in concrete work. The tool includes a plurality of elongated, substantially U-shaped caps which retain the expansion material, the caps being slidably engaged together for adjustment of the tool's length.

11 Claims, 1 Drawing Sheet

MASONRY TOOL

BACKGROUND OF THE INVENTION

This invention is in the field of apparatus for installing pavement, especially concrete slabs as found, e.g., in roadways, sidewalks, patios, etc. More specifically, this invention relates to tools and apparatus for installing expansion joints in such pavement.

Joints and jointing materials are indispensible in applications where concrete, mortar, and the like are employed. Concrete and mortar expand or contract with temperature changes, and the dimensional differences which result from temperature changes in many parts of the country lead to enormous stresses in the concrete of mortar. These stresses cause random cracking. The resultant influx of water, freezing, expansion, and further stress leads to additional cracking of the concrete or mortar and its eventual disintegration.

One way to moderate the cracking problem is to provide joints in the paving, weak spots along which the cracking preferentially occurs. However, soil and water then penetrate the joints, leading to unwanted further cracking. Thus, it has become a preferred practice to insert an expansion-absorbing material into such pavement joints. A number of materials have been proposed for this purpose over the years; e.g., a composite which includes an asphaltic or rubber binder together with a fibrous filler is often employed. This and similar expansion material is available in about 10 ft. lengths, often about ¼–½ in. thick, and 3½–4 in. wide, especially adapted for sidewalks. Expansion material with other dimensions in available for different applications, such as highways.

When such expansion material is used in building concrete pavement it must be held in place along the desired joint line by some means until the concrete is poured on either side of it. This is not an easy task, because the expansion material is quite flexible, which makes it difficult to create a straight joint, especially a straight joint in which the expansion material is held at the correct height. Various tools and techniques for solving these problems have been described.

For example, U.S. Pat. No. 1,629,544 discloses apparatus for holding such expansion material in place while the concrete is poured on either side of it. U.S. Pat. Nos. 1,588,717 and 1,891,897 describe tools, crowning devices, which hold such expansion material in place. The tools described in each of the aforesaid patents are removable after the concrete is poured.

The prior art also discloses several complete expansion joints wherein a removable portion, in the nature of a crown cover for the expansion material, is disclosed. The following U.S. Patents are relevant in this regard: 2,189,437; 3,782,846; and 4,346,542.

However, none of complete joints described in the prior art and none of the tools designed to hold a joint expansion material is practical and economical. They are not adjustable for expansion joints of different lengths. Furthermore, the joints and tools of the prior art do not provide mechanism which permits proper alignment and location of the expansion material with respect to forms in which the concrete typically is poured. It is to these deficiencies in the masonry tools of the prior art that this invention is directed.

Thus, it is one objective of this invention to provide an expansion material-holding tool which can be removed from the concrete before it is set for reuse in the same pour.

It is a further objective of this invention to provide a tool whose length can be adjusted to accommodate various lengths of expansion material to permit, for example, the same tool to be used in pouring concrete sidewalks of different widths.

A still further objective of this invention is to provide a tool which permits the expansion material to be easily located and aligned in the forms commonly employed in concrete work.

SUMMARY OF THE INVENTION

These objectives are attained in an adjustable, removable, reusable tool which includes a plurality of elongated, substantially U-shaped caps channeled wide enough to accept the expansion material and of aggregate length greater than the expansion material. The caps are slidably engaged together to be inverted over the expansion material and lengthened to accommodate it. The tool retains the expansion material in place while concrete is poured but then can be removed, adjusted and reused with expansion material of a similar or different length.

Various advantages and novel features which characterize this invention are particularly pointed out in the appended claims. However, for a better understanding of the invention, its advantages, and the objectives to be attained by its use, reference should be made to the drawings, which illustrate a preferred embodiment containing optional features, and to the detailed description which follows.

DETAILED DESCRIPTION

Figure 1:
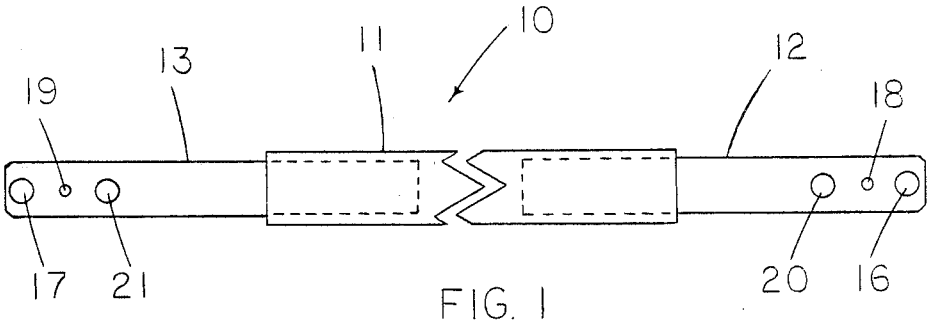
FIG. 1 is a top plan view showing one embodiment of the masonry tool of this invention.
Figure 2:
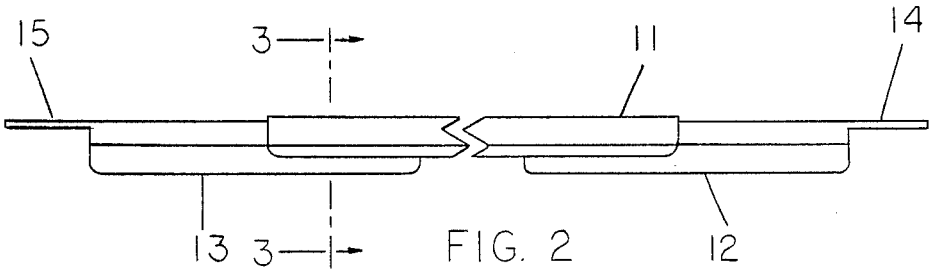
FIG. 2 is a side elevation of the masonry tool shown in FIG. 1.
Figure 3:
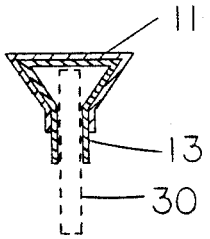
FIG. 3 is a cross-sectional view taken along line 3—3 in FIG. 2, but showing the expansion material in phantom.
Figure 4:
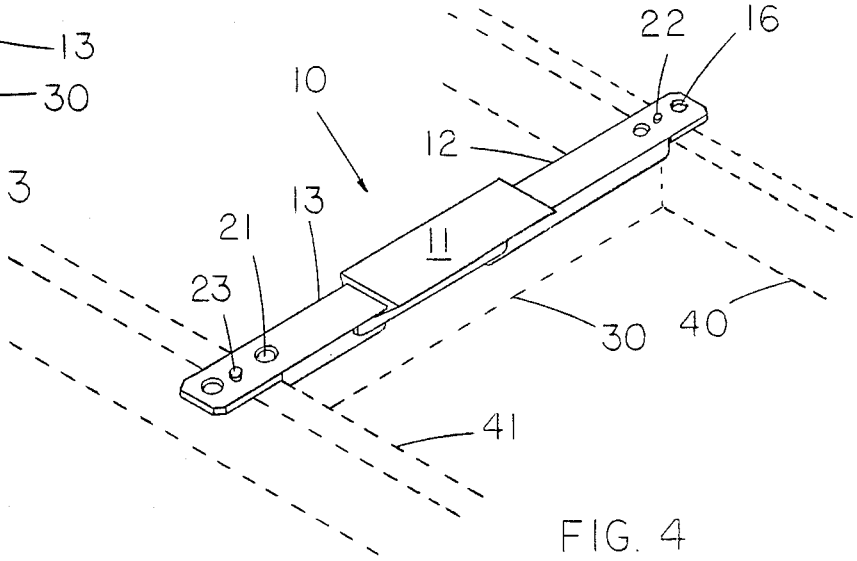
FIG. 4 is a isometric view of the masonry tool of FIGS. 1–3 in relation to forms, shown in phantom, defining the space intended to receive concrete.

The embodiment of the tool 10 illustrated in the drawings includes a set of three elongated, substantially U-shaped caps. These are central cap 11 and outer caps 12 and 13. The set of caps are slidably engaged together in that the two outer caps are channeled narrower than central cap 11. In the aggregate, the end-to-end length of the caps is greater than the length of the expansion material to be retained on edge. The slidable engagement of the caps and the retention of expansion material 30 may be most readily comprehended from FIG. 3. The caps are all channeled wide enough to accept expansion material 30, retaining it in a reasonably vertical manner.

Although a tool having a set of three caps is useful for many purposes, a greater or lesser number of slidably engaged caps can be employed advantageously, e.g., in the construction of very wide or very narrow pavements, respectively. That is, it is only necessary that the tool include a plurality of slidably engaged caps. Although, in the illustrated embodiment, central cap 11 is channeled wider than outer caps 12 and 13, so that the latter caps slide inside the former, that is not a necessary feature; e.g., central cap 11 could as well be channeled to slide inside the outer cap or caps, or the channel width of all three could be different.

As illustrated, the slidable engagement between caps 11, 12 and 13 is effected through a dovetail-like fitting. Such a fitting is relatively easy to fabricate by bending operations applied to a sheet of suitable material. This type of fitting is effective in keeping concrete away from the top of the expansion material. However, other slidable engagements are possible. For example, chef's caps or caps simply having rectangular cross-sections of different widths will suffice, as will caps with another of the many mated sliding fittings, such as slots with mated tangs, shoes sliding on rails, etc.

The caps are elongated, having a substantially U-shaped cross-section, expansion material 30 being retained in the channel of the U. The length of the caps is somewhat arbitrary, lengths of 2–3 feet being useful in sidewalk construction, for example. The legs of the U, i.e., the depth of the caps, will generally be such as required to retain the expansion material but not exceed the depth of forms defining the space intended to receive the concrete. In sidewalk construction, for example, the depth of the caps can preferably be about 2 inches. The forms employed in sidewalk construction are often about 2 in.×4 in. in cross-section, the larger dimension being the desired thickness of the concrete. With caps 11, 12 and 13 about 2 inches deep, reinforcing screen or rods can be employed to bridge concrete sections across the joint without interference from the masonry tool of this invention.

The caps employed in the masonry tool can be made of various materials. Sheet metal, especially galvanized steel or stainless steel, are useful. However, the caps may be molded or otherwise fabricated from various plastics as well, such as polystyrene and various copolymers thereof, high impact plastics, as well as composite material, such as fiberglass, or polyolefins, such as polyethylene or polypropylene, for example. In order a facilitate troweling, it is often useful to coat the top surface of the caps with a polymer, such as Teflon.

Although the masonry tool of this invention can be used effectively by simply supporting it, using any available means, in the defined space intended to receive concrete, the tool is optionally but desirably equipped with means to secure the tool with respect to forms used to define such space. This can be accomplished by providing an ear joined to at least one of the caps adjacent the form and means for securing the cap with respect to the form. For example, ears 14 and 15 can be provided on caps 12 and 13, respectively, as integral parts thereof.

In connection with ears 14 and 15, it is advantageous to provide inner holes 20 and 21 in order to view the expansion material, insuring it is in place, to assist in removing the tool, or to insert a wedge to help retain narrow expansion material. Also optional are central holes 18 and 19, through which index marks on forms 40 and 41 may be viewed and fastenings 22 and 23 removably inserted to secure caps 12 and 13 directly to adjacent wooden forms. Holes 16 and 17 may also be provided to retain caps 12 and 13, respectively, adjacent the forms by driving rods downward through them; this technique is especially useful if metal forms are employed, but one of these holes can also be used to secure the tool next to an abutting structure where no form is present. In this latter event, the expansion material is cut slightly short to allow for the rod.

In using the tool of this invention, the expansion material is placed on edge at the desired joint location, being retained in the tool, and its elevation adjusted in the space defined for receiving concrete. If desired and so provided, one or more of the outer caps is secured with respect to any form being used. Concrete may then be poured on both sides of the joint. Before the concrete hardens it may be troweled and the tool removed, rinsed with water, and reused at another joint in the same pour or stored by inverting the caps over each other, protecting the edges.

It will be evident that various embodiments of this invention, other than the embodiment illustrated in the drawings and variations thereof described above, are within the contemplation of this invention.

What is claimed is:

1. An adjustable, removable, reusable tool for retaining elongated expansion material vertically on edge across a defined space intended to receive concrete which comprises a plurality of elongated, substantially U-shaped caps channeled wide enough to accept the expansion material and of aggregate length greater than that across the defined space, said caps including a subunit having three caps, a central cap having first and second ends and being channeled to a different width than said outer caps, said outer caps being nested within said first and second ends of said central cap, said caps being slidably engageable together to be inverted over the expansion material with the legs of the U downwardly extended and lengthened across the space, whereby said tool retains the expansion material in place while concrete is poured but can then be removed, adjusted and reused across a similar or different space.

2. The tool of claim 1 wherein one or more forms define the space intended to receive concrete and said tool further comprises means for securing one or more of said caps with respect to one or more of the forms.

3. The tool of claim 2 wherein an ear is joined to at least one of said caps adjacent the form and means are provided for securing said cap with respect to the form.

4. The tool of claim 3 wherein said ear is adapted with at least one hole to be removably attached directly to the adjacent form with at least one fastening.

5. An adjustable, removable, reusable tool for retaining expansion material vertically on edge across a space defined by forms intended to receive concrete which comprises a set of three elongated, substantially U-shaped caps, a central cap and two outer caps, said caps being channeled to accept the expansion material and of aggregate length greater than that across the defined space, said central cap having first and second ends and being channeled to a different width than said outer caps, said outer caps being nested within said first and second ends of said central caps, thereby permitting said caps to be slidably engaged together to be inverted over the expansion material with the legs of the U downwardly extended and lengthened across the space, together with ears with holes joined to said outer caps adjacent the forms for securing said caps with respect thereto with fastenings.

6. A method for incorporating expansion material at a desired joint location in concrete paving to be poured into a defined space which comprises providing a tool which includes a plurality of elongated, substantially U-shaped caps channeled wide enough to accept the expansion material and of aggregate length greater than that across the defined space, said caps including a subunit having three caps, a central cap having first and second ends and being channeled to a different width than said outer caps, said outer caps being nested within said first and second ends of said central cap, said caps being slidably engaged together:

inverting said tool over the expansion material with the legs of the U downwardly extended and lengthened across the space to retain the expansion material on edge at the desired joint location;

pouring concrete on both sides of the joint; and then removing said tool before the concrete hardens.

7. The method of claim 6 wherein one or more forms define the space intended to receive concrete, said tool further comprises means for securing one or more of said caps with respect to one or more of the forms, and securing one or more of said caps with respect to one or more of the forms.

8. Ad adjustable, removable, reusable tool for retaining elongated expansion material vertically on edge across a defined space intended to receive concrete which comprises a plurality of elongated, substantially U-shaped caps channeled wide enough to accept the expansion material and of aggregate length greater than that across the defined space, said caps including a subunit having three caps, a central cap having first and second ends and being channeled to a different width than said outer caps, said outer caps being similarly nested, one within the other, with said first and second ends of said central cap, said caps being slidably engageable together to be inverted over the expansion material with the legs of the U downwardly extended and lengthened across the space, whereby said tool retains the expansion material in place while concrete is poured but can then be removed, adjusted and reused across a similar or different space.

9. The tool of claim 8 wherein one or more forms define the space intended to receive concrete and said tool further comprises means for securing one or more of said caps with respect to one or more of the forms.

10. The tool of claim 9 wherein an ear is joined to at least one of said caps adjacent the form and means are provided for securing said cap with respect to the form.

11. The tool of claim 10 wherein said ear is adapted with at least one hole to be removably attached directly to the adjacent form with at least one fastening.

* * * * *